US006181122B1

(12) United States Patent
Larsen et al.

(10) Patent No.: US 6,181,122 B1
(45) Date of Patent: Jan. 30, 2001

(54) SYSTEM AND METHOD FOR STARTING VOLTAGE AND CURRENT CONTROLLED ELEMENTS

(75) Inventors: Frode Larsen, Tinton Falls; Nianxiong Tan, Howell, both of NJ (US)

(73) Assignee: Globespan, Inc., Red Bank, NJ (US)

( * ) Notice: Under 35 U.S.C. 154(b), the term of this patent shall be extended for 0 days.

(21) Appl. No.: 09/361,713

(22) Filed: Jul. 27, 1999

Related U.S. Application Data

(60) Provisional application No. 60/098,323, filed on Aug. 28, 1998.

(51) Int. Cl.[7] ..... G05F 3/16
(52) U.S. Cl. ..... 323/313
(58) Field of Search ..... 323/313, 314, 323/315, 316; 327/535, 538, 539

(56) References Cited

U.S. PATENT DOCUMENTS

| | | | | |
|---|---|---|---|---|
| 4,839,535 | * | 6/1989 | Miller | 307/296.7 |
| 4,857,823 | | 8/1989 | Bitting | 323/314 |
| 5,084,665 | * | 1/1992 | Dixon et al. | 323/281 |
| 5,087,830 | | 2/1992 | Cave et al. | 307/296.6 |
| 5,367,249 | * | 11/1994 | Honnigford | 323/313 |
| 5,453,679 | | 9/1995 | Rapp | 323/313 |
| 5,545,978 | | 8/1996 | Pontius | 323/313 |
| 5,686,823 | | 11/1997 | Rapp | 323/313 |
| 5,811,993 | | 9/1998 | Dennard et al. | 327/54 |
| 5,818,292 | | 10/1998 | Slemmer | 327/539 |
| 5,990,672 | * | 11/1999 | Giacomini | 323/313 |

* cited by examiner

*Primary Examiner*—Matthew Nguyen
(74) *Attorney, Agent, or Firm*—Thomas, Kayden, Horstemeyer & Risley

(57) ABSTRACT

A system and method for force-starting a voltage and current controlled element is disclosed. In a simplified embodiment, a power source is coupled to the controlled element via a start-up circuit. The start-up circuit supplies a current, or voltage, to the controlled element, responsive to the voltage or current level at a specified node being below a threshold level. Preferably, two diode-connected devices may be utilized, thereby providing current forcing capability when the voltage level at the specified node is below a threshold voltage level, as specified by the diode-connected devices.

21 Claims, 2 Drawing Sheets

SYSTEM AND METHOD FOR STARTING VOLTAGE AND CURRENT CONTROLLED ELEMENTS

CROSS-REFERENCE TO RELATED APPLICATIONS

This application claims the benefit of U.S. Provisional Patent Application Serial No. 60/098,323, filed on Aug. 28, 1998, and entitled "Forced Start Up for Multi Mode Architectures (Bang-Gaps)," which is incorporated by reference herein in its entirety.

FIELD OF THE INVENTION

The present invention generally relates to circuits for supplying reference voltages and bias currents. More specifically, the invention is related to a new and efficient start-up circuit for starting voltage and current controlled elements.

BACKGROUND OF THE INVENTION

Present circuit fabrication lends itself to the creation of integrated circuits requiring biasing and initiation by a specific current or voltage value. To help bias and initiate these integrated circuits, self-biasing circuits, often called band-gap reference circuits (band-gaps), are implemented.

Band-gaps are used in a variety of integrated circuit devices as a means for generating a temperature and supply independent reference voltage, as well as a temperature and supply independent current. The band-gap provides the rest of the chip upon which it is situated with reference voltages and currents. Hence, if the band-gap doesn't start up on its own, the entire chip, and the system it is connected to, may fail to operate.

Therefore, a critical issue in the design of band-gaps is ensuring that the band-gap starts promptly and that any chance of the band-gap not starting is significantly reduced, if not eliminated altogether. To fulfill these requirements, start-up circuitry is implemented.

Several known techniques are presumably utilized to start band-gaps. Amongst these, conventional approaches have attempted to design a solution to force the self-biased circuit out of any low power state, which will not allow the self-biased circuit to start, by utilizing devices which are capable of functioning with low power. This, however, is very difficult and highly unreliable, as the properties of the low power devices cannot be properly modeled by simulation programs in this low power mode due to the simulation programs being generally incapable of accepting such low power values for parameter requirements.

Therefore, there is a need for a reliable and efficient method for initiating bandgaps.

SUMMARY OF THE INVENTION

Briefly described, the invention provides a system and method for providing a significant amount of current or voltage to a voltage and current controlled element when the element is operating in a low power mode, thereby ensuring that the element properly turns on.

Generally, the preferred embodiment of the invention comprises a voltage and current controlled element which, in normal mode, is powered by a power source, via a driving element. Within the voltage and current controlled element, a current loop is maintained, thereby causing a constant current value throughout the voltage and current controlled element and allowing the voltage and current controlled element to output a temperature independent voltage level of approximately 1.25 volts.

If, however, the voltage received from the power source is below a threshold voltage, set within the driving element, the driving element forces a large amount of current to the voltage and current controlled element. This forced current turns on the voltage and current controlled element and causes it to function as if the power source voltage was above the threshold voltage. Therefore, the voltage and current controlled element locks in an active operating point and emits approximately 1.25 volts. This eliminates the possibility of the voltage and current controlled element locking up in a low power mode.

In accordance with the preferred embodiment of the invention, an amplifier, located within the voltage and current controlled element, outputs the current value which is mirrored throughout the voltage and current controlled element, until the current loop is completed.

The invention has numerous advantages, a few of which are delineated hereafter as examples. Note that the embodiments of the invention described herein possess one or more, but not necessarily all, of the advantages set out hereafter.

One advantage of the invention is that it provides a simple and reliable procedure to prevent a self-biased circuit from locking in a low power mode.

Another advantage of the present invention is that it provides a start-up solution to band-gap failure in an area where assumption of the properties of devices used by the band-gap during low power mode, for purposes of simulating a solution to the band-gap's failure, would be otherwise be improper.

Another advantage of the present invention is that it can be utilized to reliably start-up any dormant node in a circuit which is locked at a significantly different voltage level as compared to an intended voltage level, with the mere addition of at least one current driving device.

Other objects, features, and advantages of the present invention will become apparent to one of reasonable skill in the art upon examination of the following drawings and detailed description. It is intended that all such additional objects, features, and advantages be included herein within the scope of the present invention, as defined by the claims.

BRIEF DESCRIPTION OF THE DRAWINGS

The present invention will be more fully understood from the detailed description given below and from the accompanying drawings of the preferred embodiments of the invention, which however, should not be taken to limit the invention to the specific embodiment, but are for explanation and for better understanding. Furthermore, the drawings are not necessarily to scale, emphasis instead being placed upon clearly illustrating the principles of the invention. Finally, like reference numerals in the figures designate corresponding parts throughout the several drawings.

DESCRIPTION OF THE PREFERRED EMBODIMENT

Figure 1:
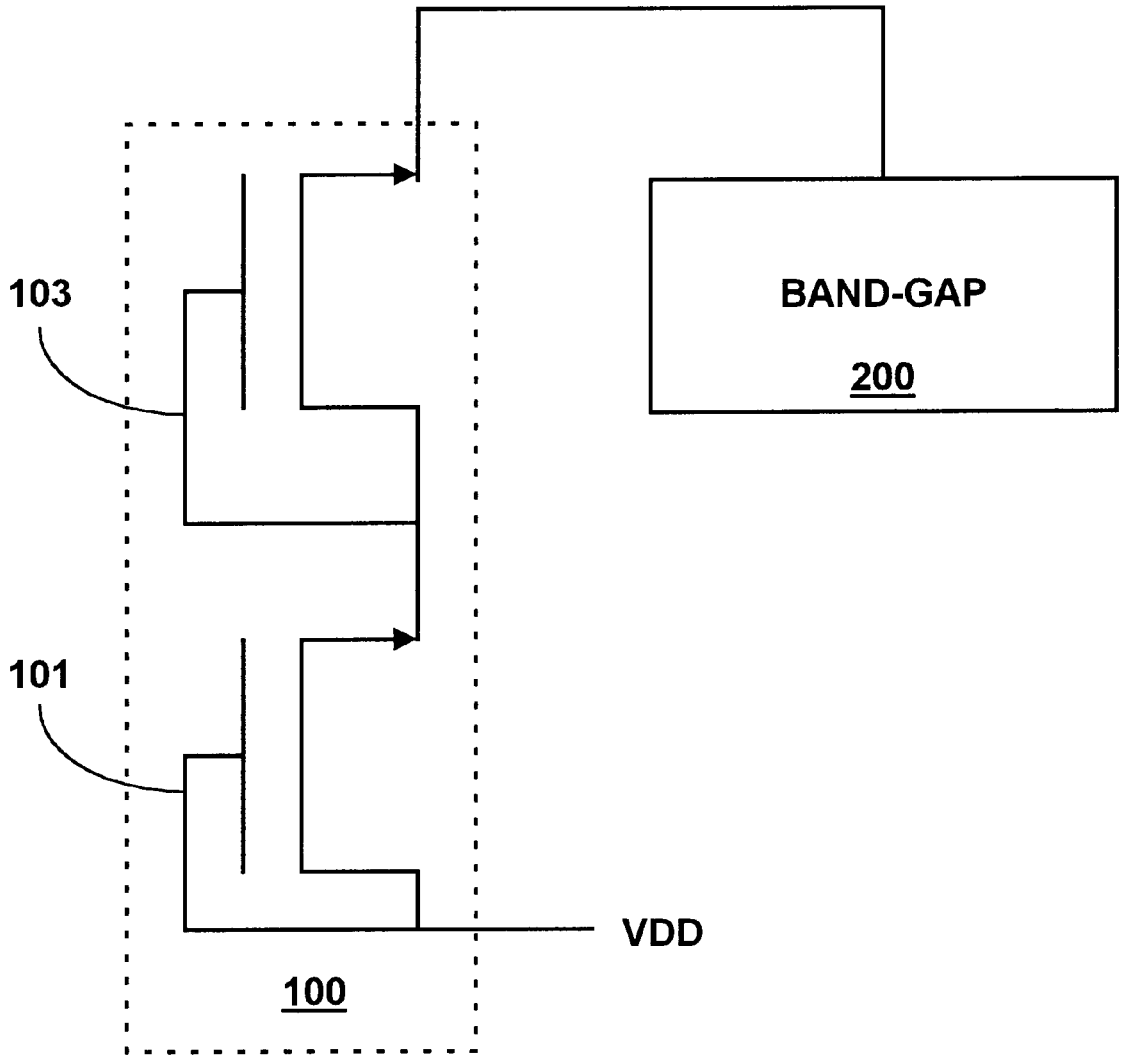
FIG. 1 depicts one embodiment of the invention, wherein a band-gap is connected to a power source via a sensing element, which is responsive to the properties of the band-gap.

Turning to the drawings, wherein like reference numerals designate corresponding parts throughout the drawings, FIG. 1 is a block diagram demonstrating one possible implementation of the present invention. A start-up circuit 100, which is capable of sensing the properties of a controlled voltage and current element 200, such as a band-gap, forces a response into the controlled element 200 based upon the sensed voltage level of the controlled element. For purposes of consistency, the controlled element will hereinafter be referred to as a band-gap, however, it is not intended that the controlled element 200 be limited as such.

In accordance with the preferred embodiment of the invention, two diode-connected devices, such as the shown metal-oxide semiconductor field-effect transistors (MOSFETs) 101 and 103 of FIG. 1, sense the voltage at a specified node of the band-gap 200, as shall be described with reference to FIG. 2 hereinbelow. Responsive to the value of the sensed voltage, the startup circuit 100 will either force a large current into the band-gap 200, or force no current at all. As an example, if the voltage at the specified node fails to be within approximately 2 volts of the power source voltage (VDD), the MOSFETs 101 and 103 will turn on and force current into the band-gap 200, thereby causing the band-gap 200 to start-up. It should be noted that one of reasonable skill in the art would understand that while the present method is described with reference to forcing a current, a voltage, or a voltage in combination with a current, may be forced by the start-up circuit 100.

Figure 2:
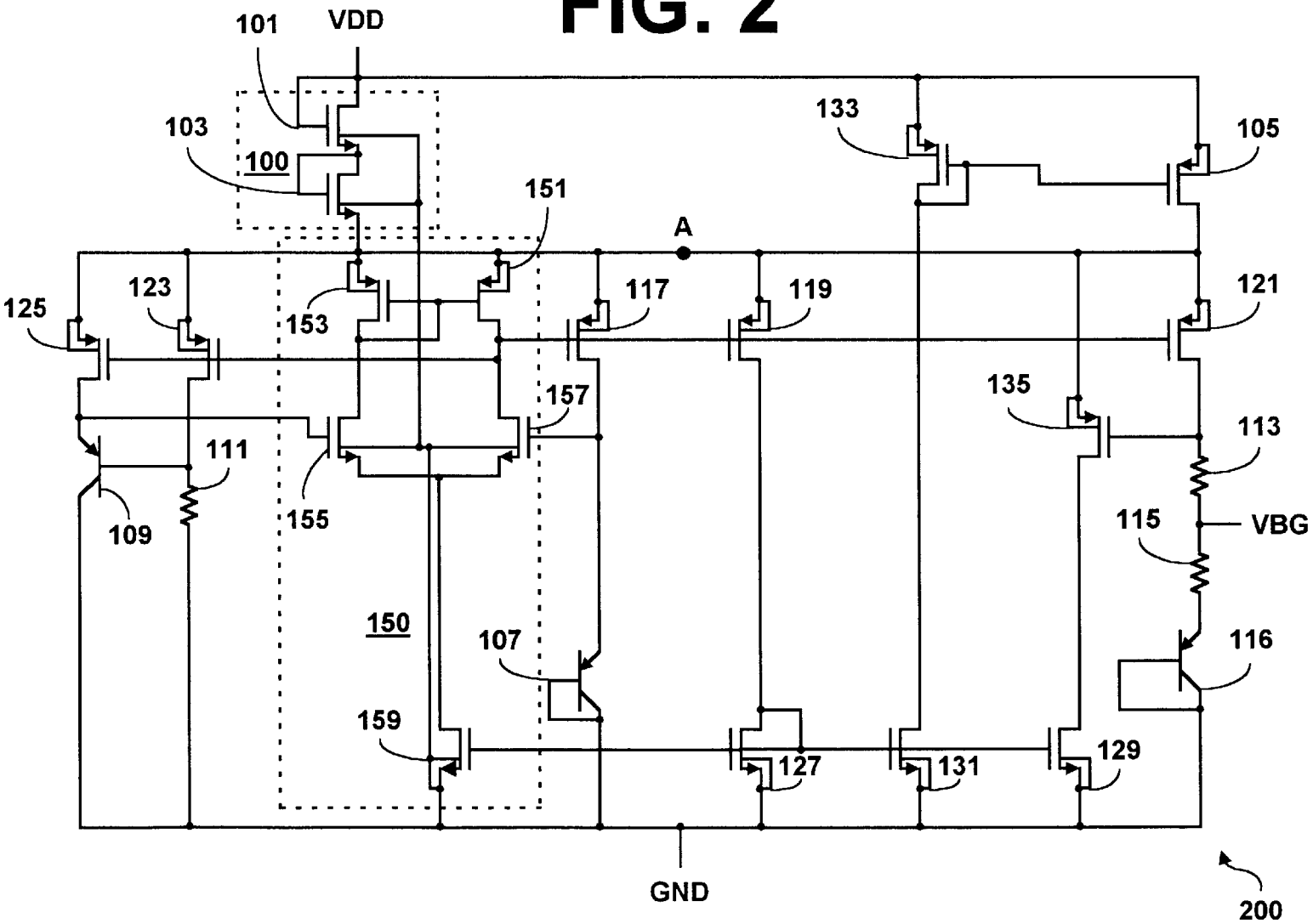
FIG. 2 depicts a band-gap circuit in accordance with the preferred embodiment of the invention having the start-up circuit of the present invention included therein.

FIG. 2 represents a typical band-gap 200 reference circuit utilizing the start-up circuit 100 in accordance with the preferred embodiment of the invention. Describing the band-gap 200 when it is properly functioning, and therefore, as a result, transmitting a voltage of approximately 1.25 volts, a VDD power supply supplies power to start-up circuitry 100, fed by a current supplied via device 105. In accordance with the preferred embodiment, start-up circuit 100 comprises two enhanced metal-oxide semiconductor field-effect transistors (MOSFETs), 101 and 103, connected in series, with the power supply connected to the drain of the first MOSFET 101. It will be appreciated by one of ordinary skill in the art that while this disclosure describes utilization of enhanced MOSFETs 101 and 103 to sense and force voltage at a node A, as shall be described herein, other devices may be utilized to perform these functions, such as NPN transistors, or diodes. Similarly, the voltage could be sensed with respect to ground, and an inverted architecture could be utilized.

An amplifier 150, preferably consisting of MOSFETs 151, 153, 155, 157 and 159 is initialized by the power source voltage (VDD) due to a lack of impact on VDD by start-up circuit 100, as shall be discussed hereinafter. The amplifier 150 compares the voltage at the emitter of transistor 107, created by the transistor's diode drop, to the voltage at the emitter of transistor 109, created by a resistor 111 in series with transistor 109, and operates to keep these two voltage values identical. Particularly, in the preferred embodiment, specific to the amplifier 150, MOSFETs 155 and 157 function to amplify the voltages of transistor 107 and transistor 109 so as to keep their emitter voltage levels identical. It should be noted that, by forcing the larger base emitter drop across transistor 107 to be equal to the smaller base emitter drop across transistor 109 and the drop across resistor 111 for properly scaled currents, the band-gap voltage tapped out between resistors 113 and 115 is made temperature insensitive to a first order. This is achieved by properly scaling the currents through mirrors 125, 123, 117, and 121 with respect to the size of devices 109, 107, and 116 such that the sum of the diode drop across 116 when added to the drop across 115 becomes temperature independent in its first derivative.

The amplifier 150 then outputs a current, which is transmitted to the gates of transistors 117, 119, 121, 123, and 125, thereby appropriately scaling the appropriate currents. This same current is also transmitted to transistor 127 via the drain of transistor 119. The current is then mirrored from the source of transistor 127 by transistors 129, 131 and 159. Transistor 131 transmits this current to transistor 133, which, in turn, mirrors the current and transmits the current to transistor 105. Transistor 105, in turn mirrors the current and supplies current to the entire band-gap 200, being devices 125, 123, 117, 121, 199, and via 119 back to 127, 129, 159, and back to 131, and 131 again closes the loop with 133 and 105. As is known by one of ordinary skill in the art, maintenance of this current value throughout the band-gap 200 locks the band-gap 200 in an active operation point, thereby causing the band-gap to consistently emit a temperature independent reference voltage of approximately 1.25 volts independent of the process and supply voltage.

In accordance with the preferred embodiment of the invention, the band-gap voltage, which, as previously mentioned is well known in the art to be approximately 1.25 volts, is increased by resistor 113 to achieve a voltage value of approximately 3 volts. The 3 volts is then emitted to the gate of transistor 135. Assuming a gate to source voltage of approximately 1 volt across transistor 135, the 3 volts is increased to approximately 4 volts. This voltage is then emitted to the sources of transistors 117, 119, 151, 153, 123 and 125, thereby supplying amplifier 150 with a 4V supply voltage. The voltage is controlled by transistor 135, while the current is supplied by transistor 105.

Contrary to the band-gap functioning properly, if the amplifier 150 is not initialized, the currents within the band-gap 200 will remain at a very low value, if not at 0 amps itself, and the band-gap 200 will not function properly. To address and prevent this problem, start-up circuit 100 is utilized. In accordance with the preferred embodiment of the invention, transistors 101 and 103 of the start-up circuit 100 contain a high enough threshold voltage to ensure that they are not initialized when the voltage at a chosen node A is over a certain voltage level. Alternatively, transistors 101 and 103 may be connected to any node within the band-gap 200 having a known voltage, which is high enough to prevent these transistors from being utilized when the voltage at node A is above a threshold voltage. It will be appreciated by one of ordinary skill in the art that an inverted architecture could be implemented, sensing the voltage at node A relative to ground, and a current value out of the node itself.

If the voltage at node A, as fed into transistors 101 and 103, is below the threshold voltage of transistors 101 and 103, a large amount of current will be emitted to the amplifier 150 via the start-up circuit 100. This amount of current is transmitted to transistors 123, 125, 117, 119 and 121. The current transmitted to transistor 119 is then mirrored into transistors 127, 129, 159, 131, and 133, and finally to transistor 105.

Transistor 105, in turn, supplies the entire band-gap with the required current. Finally, transistors 101 and 103 of the start-up circuit 100 are turned off since the voltage level transmitted to transistor 101, at node A, is now over the threshold voltage.

In concluding the detailed description of the present invention, it should be noted that it will be obvious to those skilled in the art that many variations and modifications may be made to the embodiments discussed herein without substantially departing from he principles of the present invention. All such variations and modifications are intended to be included herein within the scope of the present invention, as set forth in the following claims. Further, in the claims hereinafter, the corresponding structures, materials, acts, and equivalents of all means or step plus function elements are intended to include any structure, material, or acts for performing the functions in combination with either claimed elements as specifically claimed.

What is claimed is:

1. A system for efficiently providing a reference voltage and a bias current comprising:

a driving element; and a voltage and current controlled element attached to a power source via said driving element, wherein said driving element initializes said voltage and current controlled element responsive to the power source being below a threshold level, and wherein said driving element does not consume power when said power source is above said threshold level.

2. The system of claim 1, wherein said voltage and current controlled element is a band-gap.

3. The system of claim 1, wherein said driving element comprises a first and a second diode connected device connected in series to said voltage and current controlled element.

4. The system of claim 3, wherein said first and second diodes are MOSFETs.

5. The system of claim 2, wherein said band-gap is temperature independent.

6. The system of claim 1, wherein said voltage and current controlled element emits a voltage of approximately 1.25 volts in response to being initialized by said driving element.

7. The system of clam 1, wherein said driving element is selected from the group consisting of a current driving element and a voltage driving element.

8. The system of claim 1, wherein said driving element is both a current and voltage driving element.

9. A band-gap capable of reliably starting at power-up comprising:

a voltage and current controlled element; and a start-up circuit, capable of initializing said voltage and current controlled element, responsive to a first measurement level at a first node within said voltage and current controlled element, being below a threshold level, wherein said start-up circuit does not consume power when said first measurement level of said first node is above said threshold level.

10. The band-gap of claim 9, wherein said voltage and current controlled element is temperature insensitive.

11. The band-gap of claim 9, wherein said start-up circuit comprises a first and a second diode connected device connected in series to said voltage and current controlled element.

12. The band-gap of claim 9, wherein said first measurement level is a power source voltage level.

13. The band-gap of claim 9, wherein said initializing is further defined by driving a current into said controlled element.

14. The band-gap of claim 9, wherein said initializing is further defined by driving a voltage into said controlled element.

15. The band-gap of claim 9, wherein said first measurement level is selected from the groups consisting of a current level and a voltage level.

16. A method of reliably and efficiently initializing a voltage and current controlled element when the voltage and current controlled element does not initialize at power-up:

detecting the voltage level of a first voltage, at a first node, wherein said first node is internal to the voltage and current controlled element; and driving a current into the voltage and current controlled element, responsive to the voltage level at said first node being below a threshold level, thereby initializing the voltage and current controlled element, wherein said method does not consume power when said voltage level of said first voltage is above said threshold level.

17. The method of claim 16, wherein said first voltage is a power source voltage.

18. The method of claim 16, wherein said step of driving said current into the voltage and controlled element is performed by a start-up circuit.

19. The method of claim 18, wherein said start-up circuit is further defined by a first and a second diode connected device connected in series to the voltage and current controlled element.

20. The method of claim 16, wherein the voltage and current controlled element is a band-gap.

21. The method of claim 16, wherein said controlled element is temperature independent.

* * * * *